US006392526B1

(12) United States Patent
Roberts et al.

(10) Patent No.: US 6,392,526 B1
(45) Date of Patent: May 21, 2002

(54) FUSE CUTOUT WITH MECHANICAL ASSIST

(75) Inventors: Gerald B. Roberts, Paris; Daren A. Clark; Robert A. Brown, both of Centralia, all of MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/560,816

(22) Filed: Apr. 28, 2000

(51) Int. Cl.[7] ..... H01H 85/54; H01H 85/055; H01H 85/02

(52) U.S. Cl. ..... 337/178; 337/176; 337/171; 337/292; 361/104

(58) Field of Search ..... 337/169–179, 337/292; 361/102, 115, 104

(56) References Cited

U.S. PATENT DOCUMENTS

| | | | | | |
|---|---|---|---|---|---|
| 1,939,371 | A | | 12/1933 | Spurgeon | |
| 2,074,913 | A | * | 3/1937 | Johnson | 200/116 |
| 2,088,415 | A | | 7/1937 | Heinrich | |
| 2,174,476 | A | | 9/1939 | Pittman et al. | |
| 2,230,955 | A | | 2/1941 | Johnson | |
| 2,269,372 | A | | 1/1942 | Johnson | |
| 2,310,466 | A | | 2/1943 | Schultz et al. | |
| 2,324,888 | A | | 7/1943 | Strobel | |
| 2,458,742 | A | | 1/1949 | Schultz | |
| 2,464,565 | A | | 3/1949 | Evans et al. | |
| 2,584,586 | A | | 2/1952 | Hubbard | |
| 2,862,080 | A | | 11/1958 | Yonkers | |
| 2,910,560 | A | | 11/1959 | Stroup et al. | |
| 3,594,676 | A | * | 7/1971 | Misare | 337/180 |
| 3,827,010 | A | | 7/1974 | Cameron et al. | |
| 4,184,138 | A | * | 1/1980 | Beard et al. | 337/168 |
| 4,326,184 | A | * | 4/1982 | Murdock | 337/168 |
| 4,540,968 | A | | 9/1985 | Kato et al. | |
| 4,546,341 | A | | 10/1985 | McNaghten et al. | |
| 4,768,010 | A | * | 8/1988 | Brown et al. | 337/169 |
| 4,774,488 | A | | 9/1988 | Field | |
| 4,857,879 | A | | 8/1989 | Morgan | |
| 4,885,561 | A | | 12/1989 | Veverka et al. | |
| 5,274,349 | A | | 12/1993 | Hassler et al. | |
| 5,440,287 | A | | 8/1995 | Hassler et al. | |
| 5,463,366 | A | * | 10/1995 | Hassler et al. | 337/176 |
| 5,485,136 | A | | 1/1996 | Johnson et al. | |
| 5,559,488 | A | * | 9/1996 | Hassler et al. | 337/158 |
| 5,566,423 | A | | 10/1996 | Hassler | |
| 5,583,729 | A | | 12/1996 | Hassler et al. | |
| 5,760,673 | A | * | 6/1998 | Hassler et al. | 337/168 |
| 5,805,046 | A | | 9/1998 | Hassler et al. | |
| 5,854,582 | A | * | 12/1998 | Clark et al. | 337/169 |
| 5,936,506 | A | | 8/1999 | Hassler et al. | |

OTHER PUBLICATIONS

Hubbell Power Systems Catalog titled Cutout and Cutout–Arrester Combinations; pp. 10A–1 to 10A–7; Nov. 1996.

* cited by examiner

*Primary Examiner*—Leo P. Picard
*Assistant Examiner*—Anatoly Vortman
(74) *Attorney, Agent, or Firm*—Tara L. Hoffman; Mark S. Bicks; Alfred N. Goodman

(57) ABSTRACT

A fuse cutout for connection to a power source comprising, a mounting having upper and lower support members extending from opposing ends of the mounting, respectively. A holder member fixedly attached to the lower support of the mounting. A pivot member received in the holder member at a first pivot point, the pivot member being movable between first and second positions. A fuseholder having upper and lower ends, the lower end being pivotally attached to the pivot member at a second pivot point, the fuseholder being movable between closed and open positions corresponding to the first and second positions of the pivot member, respectively. A first biasing member disposed between the pivot member and the lower end of the fuseholder at the second pivot point, biasing the pivot member toward the second position. The pivot member includes a planar cam surface that engages a lower contact of the holder member.

33 Claims, 9 Drawing Sheets

FUSE CUTOUT WITH MECHANICAL ASSIST

FIELD OF THE INVENTION

The present invention generally relates to fuse cutouts used with power distribution systems as protective devices against over current. In particular, the fuse cutout includes a mounting assembly, a pivotally movable fuseholder assembly received in the mounting assembly, and a spring member for biasing the fuseholder toward an open drop-out position.

BACKGROUND

The primary purpose of a fuse cutout is to provide protection for power distribution systems and the various apparatus on those power lines such as transformers and capacitor banks. An over current in the system can occur under various conditions, such as an animal or tree contacting the power lines or more than one power line contacting each other. The fuse cutout acts to interrupt the current, and then the fuseholder of the cutout "drops out", thereby preventing the voltage from being impressed across the fuseholder and providing a visual indication of operation to the utility line crew.

Problems have occurred with the prior art cutouts in corrosive environments. Specifically, corrosive build up on the moving parts of the cutout cause friction which prevents the cutout from dropping out when the fuse element melts. Thus, the voltage is not removed from across the fuse holder. In addition, external flashovers can result from the cutout not dropping out. Moreover, the fuse cutout itself is typically burned up and damaged.

The present fuse cutouts do not provide a manner of either overcoming or reducing the friction due to the corrosion build up. In addition, the present fuse cutouts cannot ensure a consistent drop-out of the fuseholder upon each occurrence of a melted fuse element. Furthermore, the prior art cutouts may fail to provide protection against damage to the cutout.

Examples of prior art fuse cutouts are disclosed in the following U.S. Pat. No. : 1,939,371 to Spurgeon; U.S. Pat. No. 2,174,476 to Pittman et al.; U.S. Pat. No. 2,464,565 to Evans et al.; and U.S. 4,540,968 to Kato et al.

SUMMARY OF THE INVENTION

Accordingly, an object of the present invention is to provide a fuse cutout that increases the forces for overcoming the friction resulting from corrosion simply and inexpensively.

Another object of the present invention is to provide a fuse cutout that reduces the friction resulting from the build up of corrosion between moving parts of the fuse cutout.

A further object of the present invention is to provide a fuse cutout with a mechanical assist, such as a spring member, for overcoming the friction due to corrosion.

Yet another object of the present invention is to provide a fuse cutout that provides a consistent drop-out of the fuseholder upon the occurrence of an over current.

A yet further object of the present invention is to provide a fuse cutout that prevents damage to the cutout.

The foregoing objects are basically attained by providing a fuse cutout for connection to a power source comprising, a mounting having upper and lower support members extending from opposing ends of the mounting, respectively. A holder member is fixedly attached to the lower support of the mounting. A pivot member is received in the holder member at a first pivot point, the pivot member being movable between first and second positions. A fuseholder has upper and lower ends, the lower end being pivotally attached to the pivot member at a second pivot point, the fuseholder being movable between closed and open positions corresponding to the first and second positions of the pivot member, respectively. A first biasing member is disposed between the pivot member and the lower end of the fuseholder at the second pivot point, biasing the pivot member toward the second position.

The foregoing objects are also attained by a fuse cutout comprising a mounting having upper and lower support members extending from opposing ends of the mounting, respectively. A holder member is fixedly attached to the lower support of the mounting, the holder member having a contact portion. A pivot member is received in the holder member at a first pivot point and is movable between first and second positions. The pivot member has a planar cam surface engaging the contact portion of the holder member with a first pressure when the pivot member is in the first position, and engages the contact portion with a second pressure when the pivot member is in the second position, the second pressure being substantially less than the first pressure. A fuseholder has upper and lower ends, the lower end being pivotally attached to the pivot member at a second pivot point.

By designing the fuse cutout in this fashion, the friction resulting from corrosion build up can be overcome. Thus, the fuse cutout of the present invention has provides a consistent drop-out of the fuseholder upon each occurrence of an over current.

Other objects, advantages and salient features of the invention will become apparent from the following detailed description which taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE PREFERRED EMBODIMENT

Figure 1:
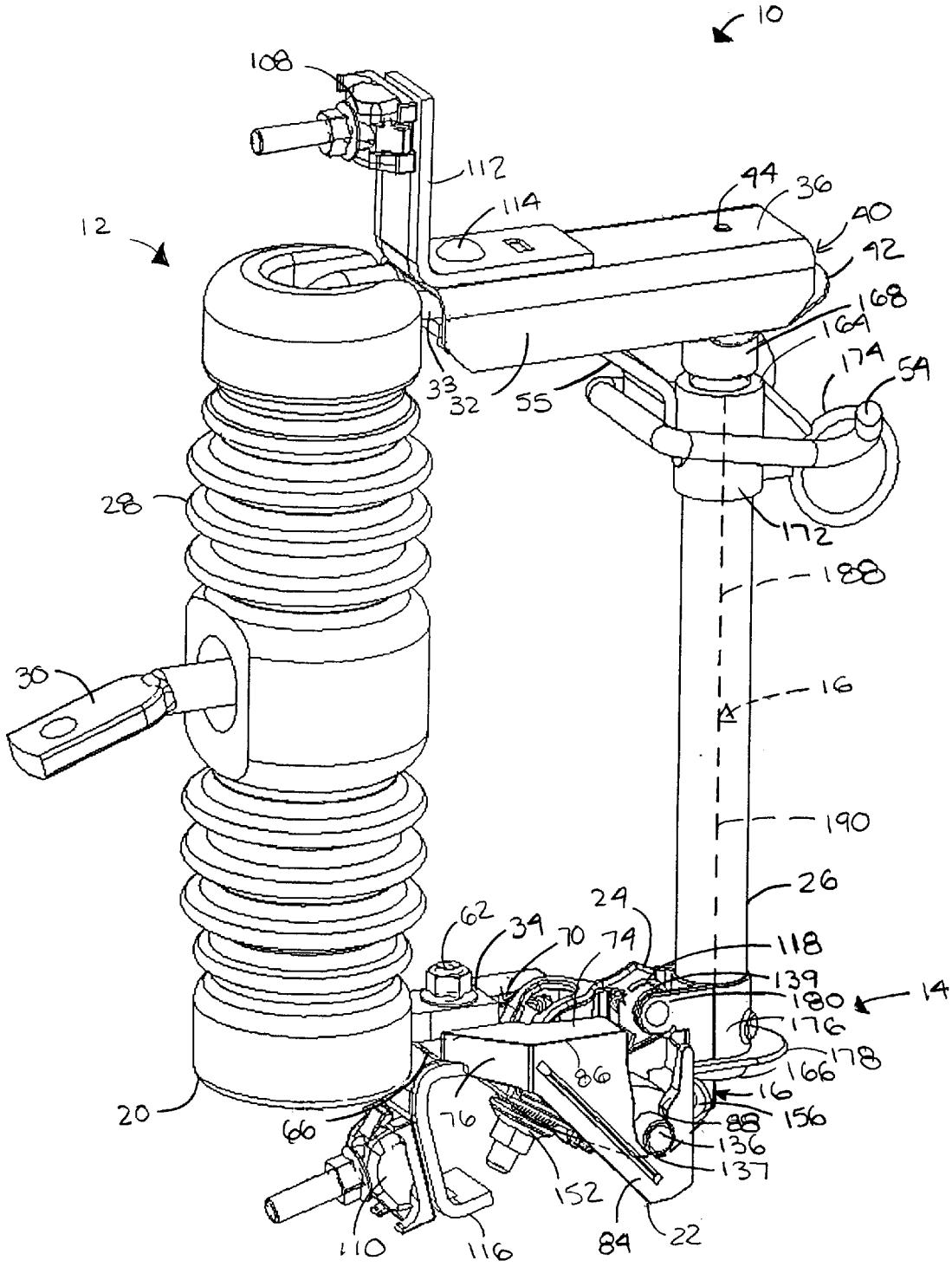
FIG. 1 is rear, side, perspective view of a fuse cutout according to an embodiment of the present invention, illustrating a fuseholder assembly of the cutout in a closed position.
Figure 2:
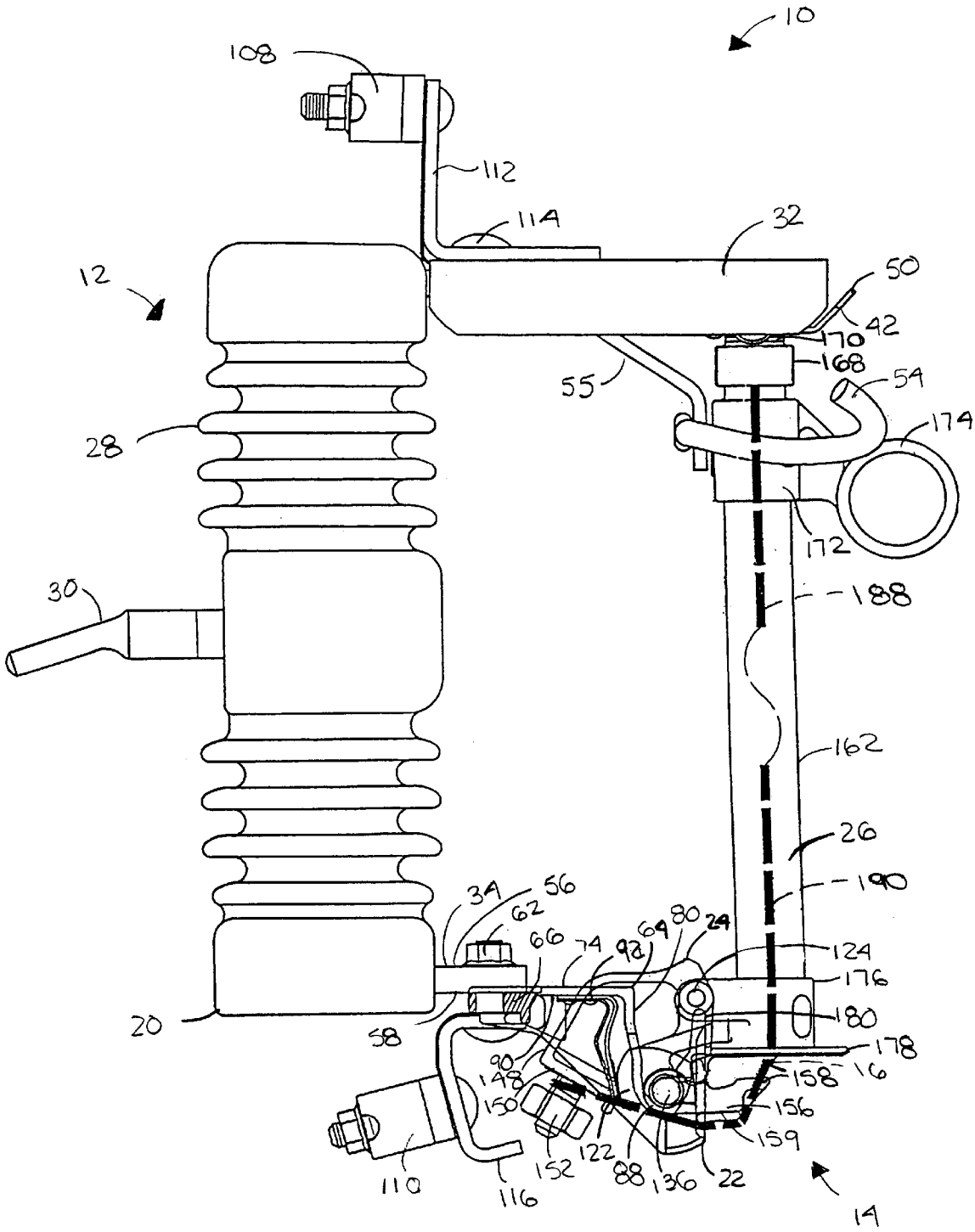
FIG. 2 is a side elevational view of the fuse cutout illustrated in FIG. 1, with a portion of a holder member of the fuse cutout removed to show the connection between a trunnion and a fuseholder of the fuseholder assembly.
Figure 3:
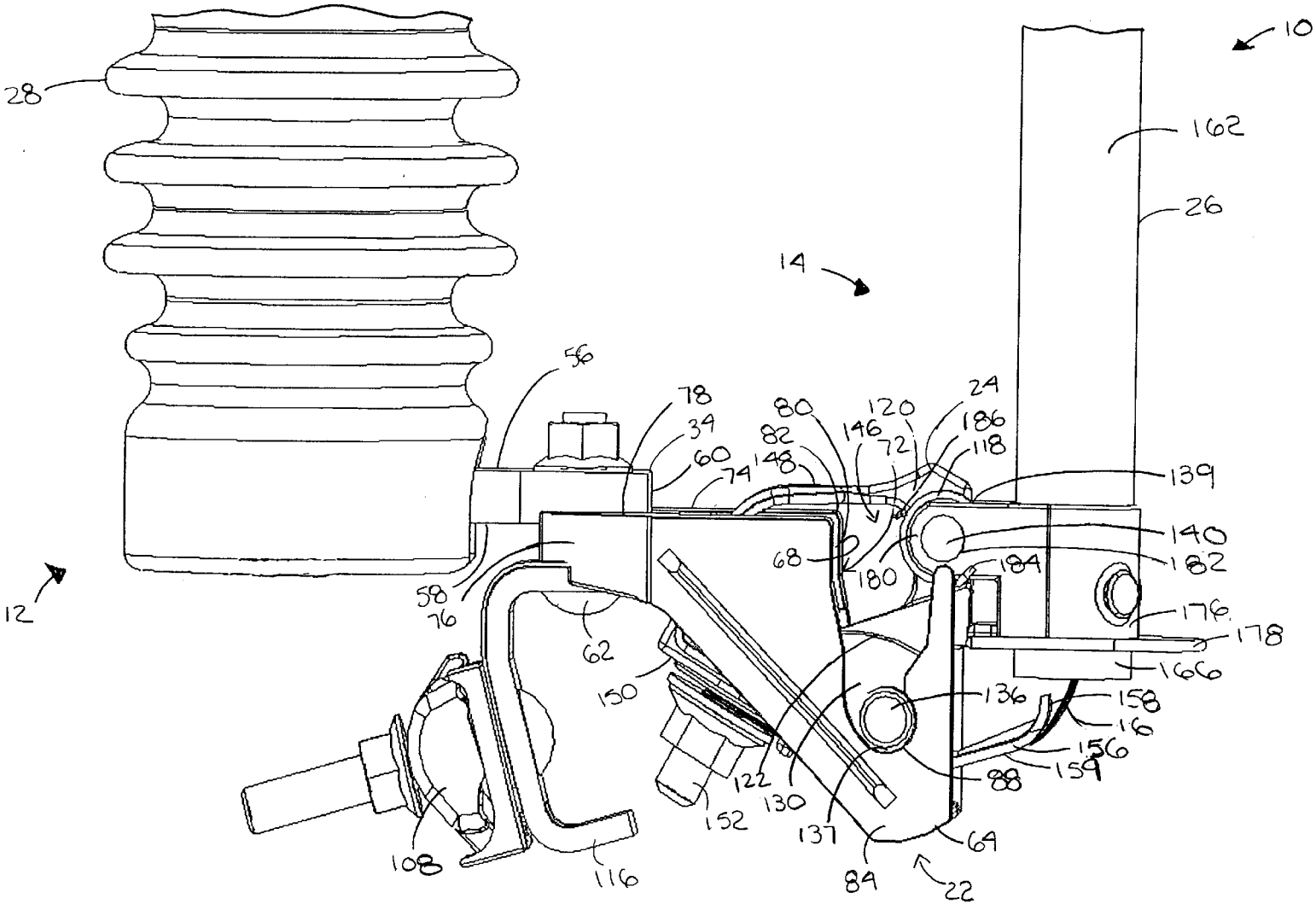
FIG. 3 is an enlarged, side, partial, perspective view of the fuse cutout illustrated in FIG. 1, showing the trunnion, and the fuseholder in the closed position.
Figure 4:
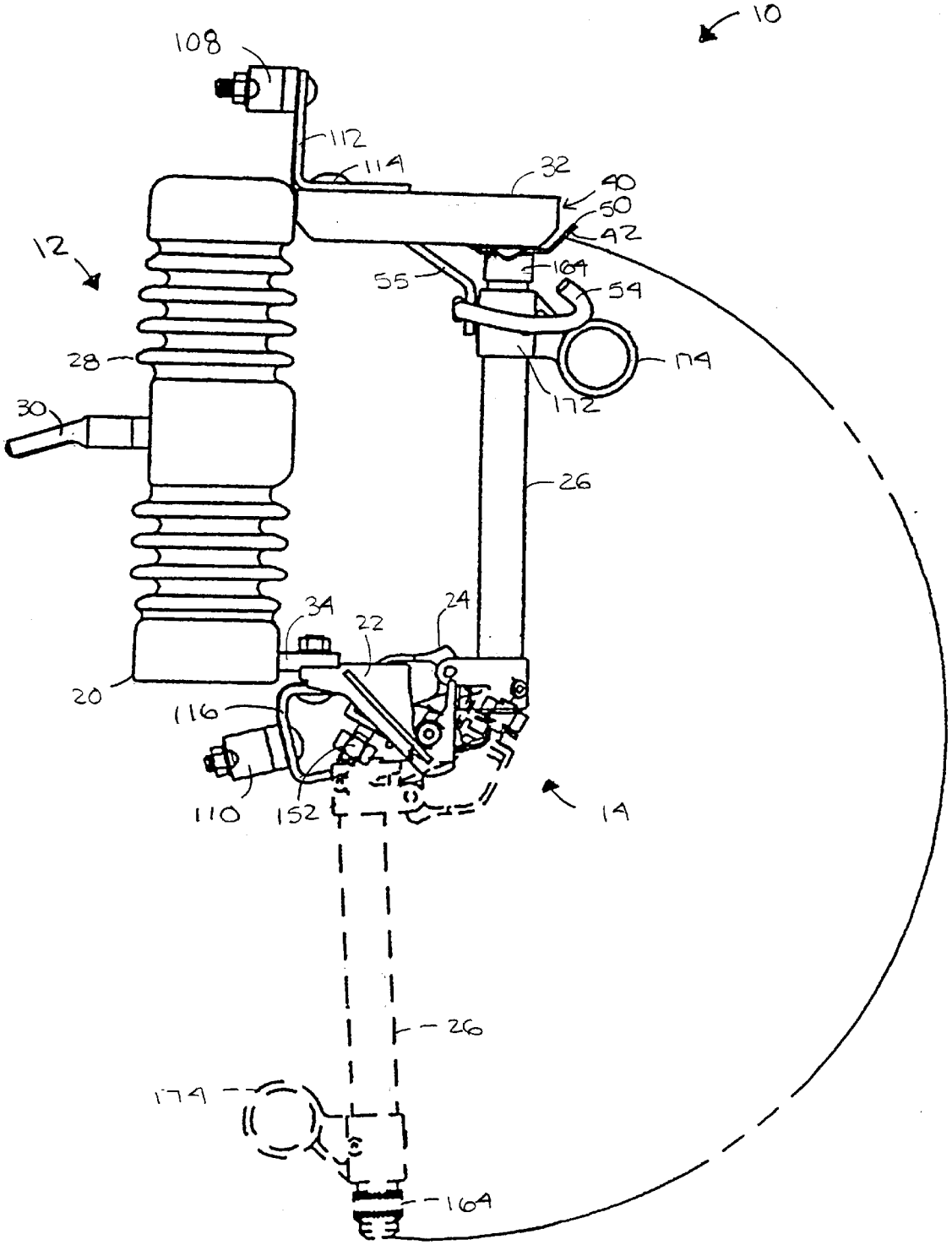
FIG. 4 is a side elevational view of the fuse cutout illustrated in FIG. 1, showing the fuseholder in the closed and drop-out positions.
Figure 5:
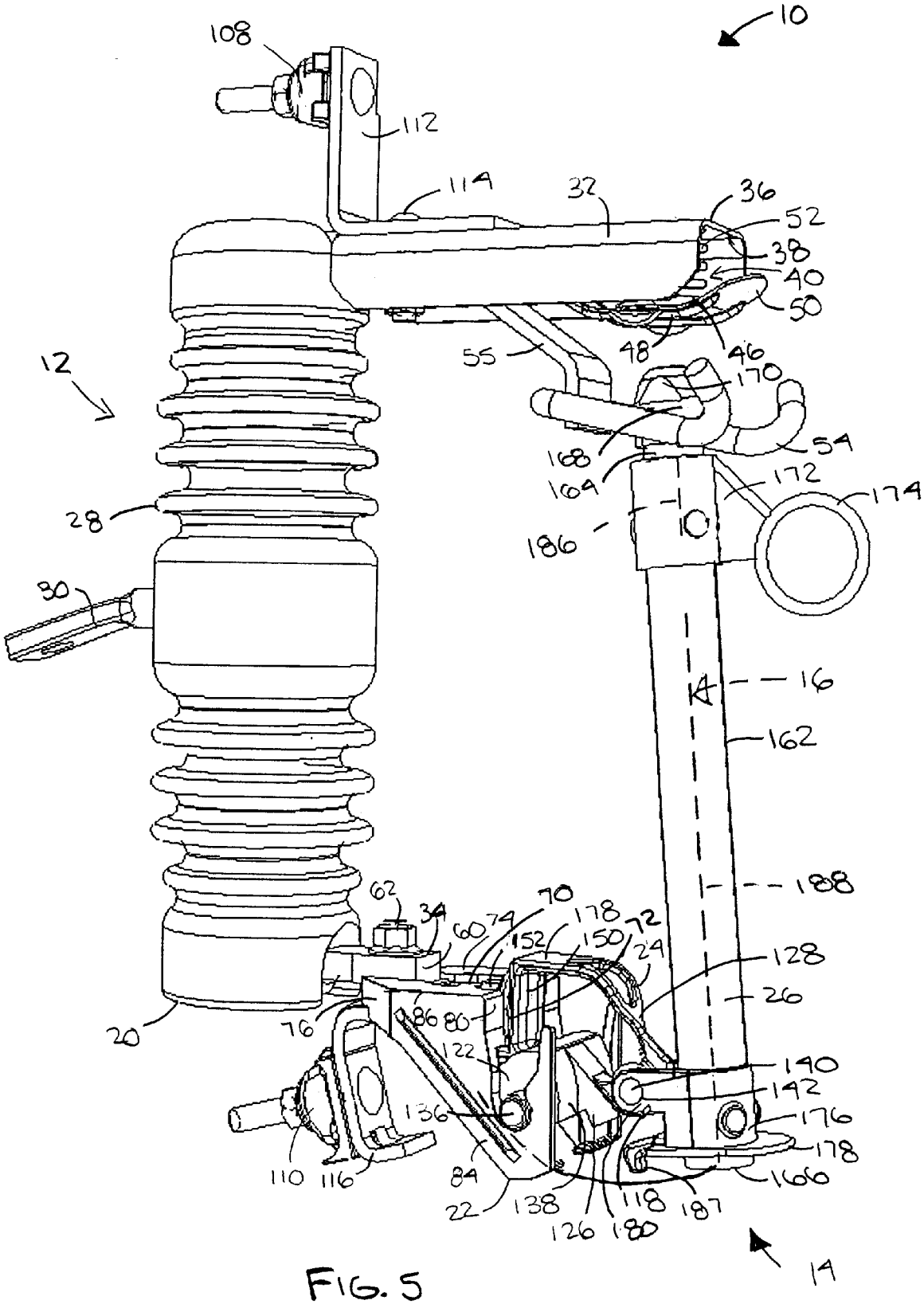
FIG. 5 is a front, side, perspective view of the fuse cutout illustrated in FIG. 1, showing the fuseholder assembly in an open position.
Figure 7:
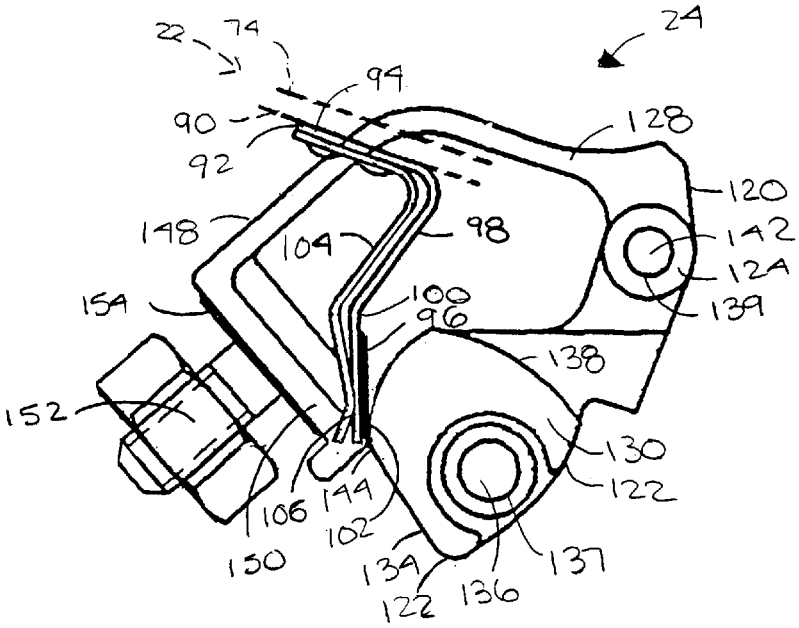
FIG. 7 is an enlarged, side elevational view of the trunnion of the fuse cutout illustrated in FIG. 1, showing the trunnion in the closed position.
Figure 8:
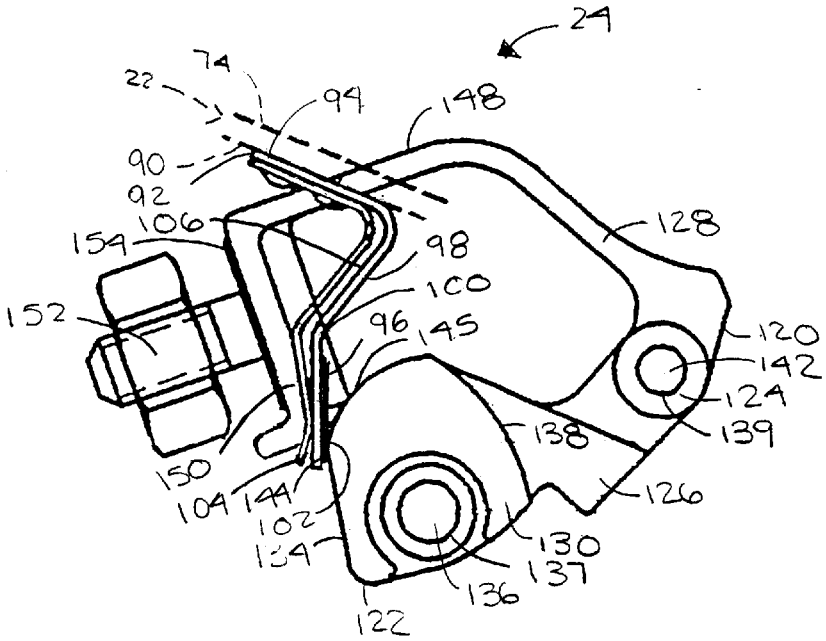
FIG. 8 is an enlarged, side elevational view of the trunnion of the fuse cutout illustrated in FIG. 5, showing the trunnion in the open position.
Figure 9:
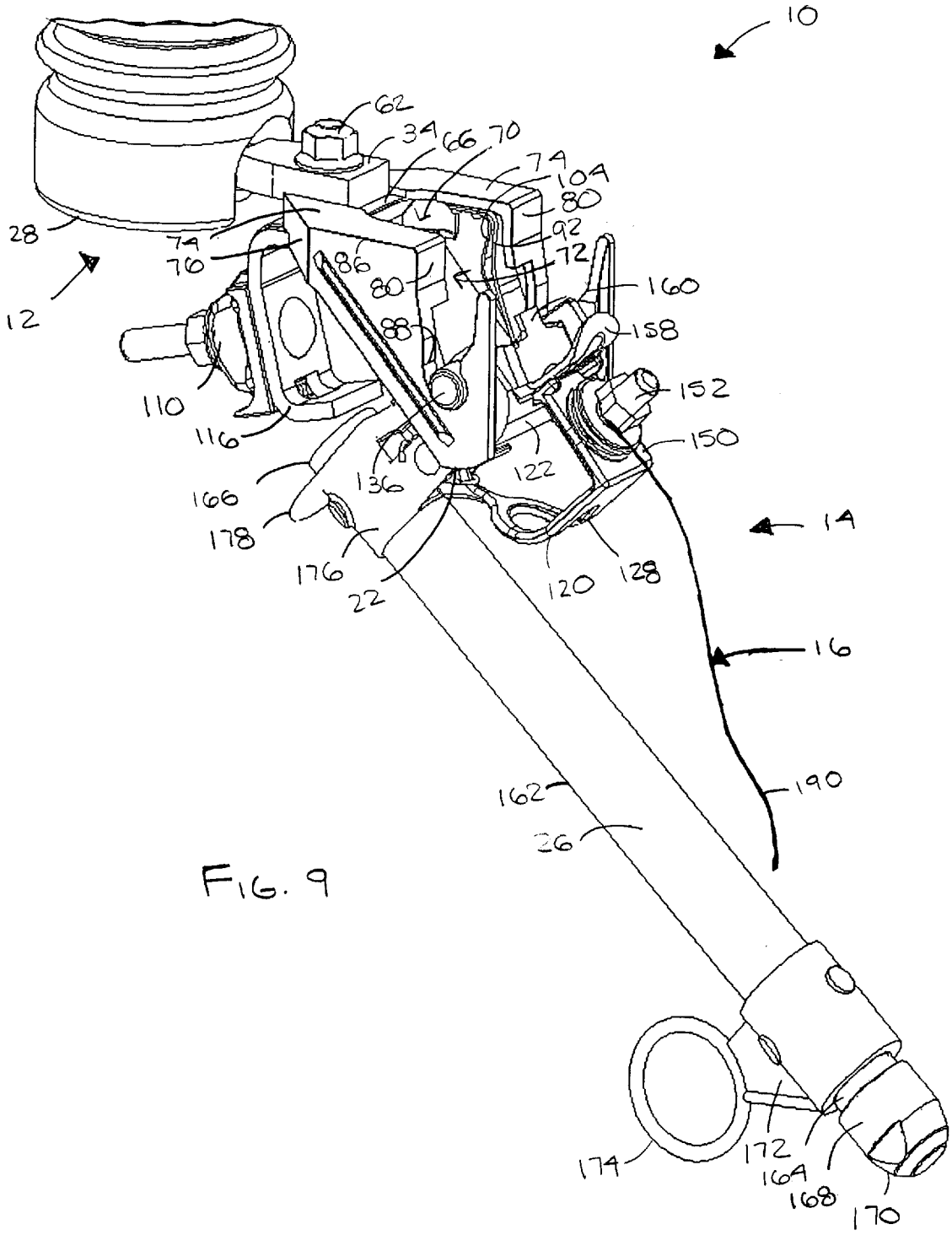
FIG. 9 is a front, side, partial, perspective view of the fuse cutout illustrated in FIG. I, showing the fuseholder in the drop-out position.

Referring to FIGS. 1–10, a fuse cutout 10 according to the present invention comprises a mounting assembly 12 and a fuseholder assembly 14 supported by mounting assembly 12. Fuse cutout 10 generally operates as a protective device for a power distribution system. Under normal conditions, fuseholder assembly 14 of fuse cutout 10 is in a closed position, as seen in FIG. 1, allowing current to pass through the system. However, upon occurrence of an over current, fuse cutout 10 acts to interrupt the current flow. Fuseholder assembly 14 is an expulsion type fuseholder, as is well known in the art. In particular, a fuse element 16 in fuseholder assembly 14 melts allowing fuseholder assembly 14 to drop to an open position, as seen in FIG. 5, and then subsequently to drop to a full "drop-out" position, as best seen in FIGS. 4 and 9.

Fuse cutout 10 is mounted to a system support, such as a pole (not shown), via mounting assembly 12, and is typically located within a conductor. Mounting assembly 12 comprises a mounting 20 and a hinge or holder member 22. Fuseholder assembly 14 comprises a trunnion or pivot member 24, which is received in hinge member 22 once assembly 12 is mounted, and a fuseholder 26 pivotally attached to trunnion 24.

As seen in FIGS. 1–5, mounting 20 includes a generally cylindrical one-piece porcelain insulator or insulating member 28 with a mounting member 30 extending rearwardly therefrom for attachment to the system pole. Upper and lower support members 32 and 34 extend from opposing ends of insulator 28 in a frontward direction. Upper support member 32 extends from a member 33 and includes top and bottom surfaces 36 and 38, wherein top surface 36 is substantially planar and bottom surface 38 forms a channel 40 such that the cross-section of upper support member 32 has generally an upside down U-shape. Upper support member 32 is preferably made of galvanized or stainless steel.

A top or upper contact 42 is attached to upper support member 32 by a rivet 44 and extends downwardly from bottom surface 38 so that top contact 42 is disposed in channel 40. Contact 42 comprises a substantially planar portion 46 having a bottom surface with a slight depression or cavity 48 formed therein. Cavity 48 extends upwardly into channel 40, as best seen in FIG. 5, and receives fuseholder 26 when in the closed position. A guide portion 50, unitary with planar portion 46, extends slightly beyond upper support member 32 and is angled upwardly to provide self-aligning action during closing of fuseholder 26. Contact 42 is made of a highly conductive material, such as copper, and can be silver plated to resist corrosion. A biasing member 52 disposed in channel 40 between bottom surface 38 and contact 42, biases contact 42 downwardly to maintain contact pressure on fuseholder 26. Preferably, biasing member 52 is a stainless steel spring.

Upper support member 32 also includes two steels hooks 54 connected at one end and attached to bottom surface 38 by a bracket 55, wherein one end of bracket 55 is attached to upper support member 32 and the opposing end is attached to hooks 54. Hooks 54 are spaced from one another such that fuseholder 26 can be easily received therebetween. The primary purpose of hooks 54 is for connection to a load break tool (not shown), however, hooks 54 also serve as a guide for fuseholder 26 upon its closing.

Lower support member 34 has planar top and bottom surfaces 56 and 58 and a central hole located near the end 60 of lower support member 34 for receiving a fastener 62, such as a bolt. Holder or hinge member 22 is attached to bottom surface 58 of lower support member 34 by fastener 62. Lower support member is also preferably formed of galvanized or stainless steel.

Hinge member 22 comprises two symmetrical parts 64 joined at a rear end by wall 66 and open at a front end 68 forming a gap 70 between parts 64 providing an inner receiving area 72 for trunnion 24. Each part 64 includes a substantially flat top plate 74, a rear plate 76 extending downwardly from the rear edge 78 of top plate 74 and an opposing front plate 80 extending from the front edge 82 of top plate 74. Front plate 80 extends further than rear plate 76. An outward side plate 84 extends downwardly from the outer edge 86 of top plate 74 such that side plates 84 of each part 64 are facing outwardly and enclose inner receiving area 72. Each side plate 84 has a substantially trapezoidal shape to match the differing lengths of rear and front plates 76 and 80. Extending from front plate 80 of each part 64 is a hook-type member that forms a deep U-shaped slot 88 for receiving and providing a large pivot area for trunnion 24. Slots 88 further allow trunnion 24 to be easily inserted and removed from hinge member 22. Preferably, hinge member 22 and parts 64 are made of a highly conductive material, such as copper. In addition, hinge member 22 can be plated with a corrosive resistant material.

As seen in FIGS. 7 and 8, each top plate 74 further includes a lower contact 92 having first and second end portions 94 and 96 with a middle portion 98 connecting first and second end portions 94 and 96. First end portion 94 is attached to bottom surface 90 of top plate 74 such that first end portion 94 is flush with bottom surface 90. Middle portion 98 extends downwardly from first end portion 94 at an acute angle forming a generally L-shape with first end portion 94. Second end portion 96 extends downwardly from middle portion 98 at an obtuse angle forming a central bend 100 in lower contact 92. Each lower contact 92 includes a contact portion 102 proximate second end portion 96 that engages trunnion 24 creating a current path. This design of lower contact 92 reduces the contact surface area between contact portion 102 and trunnion 24 thus reducing any friction created by corrosion, as will be describe further below. Each lower contact 92 is a unitary thin plate preferably formed of a highly conductive material, such as copper, and can be plated to assure low resistance current transfer from trunnion 24.

Parallel current paths are created by each lower contact 92. These parallel current paths are backed up by high strength cantilever springs 104 that are also riveted to top plate 74 of hinge member 22. One spring 104 is disposed behind each lower contact 92 and has a shape conforming to the shape of lower contacts 92. Springs 104 apply pressure on the rear surface 106 of each lower contact 92 near second end portion 96 to maintain the current path.

As seen in FIGS. 1–5, opposing upper and lower terminals 108 and 110 extend from mounting 20. Preferably, both terminals 108 and 110 are tin-plated bronze terminals, as known in the art, with upper terminal 108 connected to upper support member 32 by an upper bracket 112 mated to upper support member 32 by a fastener 114. Similarly, lower terminal 110 is mated to lower support member 34 by a lower bracket 116 connected to lower support member 34 by fastener 62 with rear end wall 66 of hinge member 22 being disposed between bottom surface 58 of lower support member 34 and the top surface of lower bracket 116, as best seen in FIG. 2.

Referring to FIGS. 1–10, trunnion or pivot member 24 of fuseholder assembly 14 is pivotally attached to fuseholder 26 with a biasing member 118 disposed therebetween, biasing trunnion 24 and fuseholder 26 together. Upon placing trunnion 24 in hinge member 22 of mounting assembly 12, biasing member 118 provides a mechanical assist in the actuation of fuseholder 26 to the drop-out position, as will be described in detail below. Biasing member 118 is preferably a torsion spring.

Trunnion 24 comprises a trunnion body 120 having a cam or camming portion 122, a pivot portion 124, and first and second arm portions 126 and 128, as best seen in FIGS. 7 and 8. In particular, cam portion 122 is an elongated member having opposing ends 130 and a middle section 132 extending therebetween, and its width sized to fit within inner receiving area 72 of hinge member 22, between parts 64. Cam portion 122 is generally cylindrical to allow for smooth rotation with respect to hinge member 22. However, cam portion 122 does include a rear planar cam surface 134 that provides pressure relief for lower contacts 92 reducing the effect of friction due to corrosion. At each opposing end 130 an extension or pin 136 extends outwardly therefrom for engaging slots 88 of hinge member 22 at a first pivot point 137, allowing cam portion 122 to rest in inner receiving area 72.

First arm portion 126 has a width substantially less than the width of cam portion 122, and extends from a front side 138 of cam portion 122 at middle section 132 to pivot portion 124 providing a rigid support therebetween. Pivot portion 124 has substantially the same width as first arm portion 126 and is coupled with fuseholder 26 at a second pivot point 139 by a pin 140 received in a pin hole 142 disposed in pivot portion 124.

Second arm portion 128 extends from pivot portion 124 at an end opposite first arm portion 126 and meets the rear side 144 of cam portion 122 at middle section 132 forming a substantially D-shaped trunnion body 120 with an open inner area 146. Open inner area 146 allows a protective tool, such as a hot stick, to be inserted through trunnion body 120 upon moving and operation of fuseholder assembly 14. Second arm portion 128 includes a bracing portion 148 extending from pivot portion 124 and a rear wall portion 150 extending downwardly at a generally right angle from bracing portion 148 to rear side 144 of cam portion 122. Rear wall portion 150 has a width sized to accommodate a stud 152 attached to a planar rear surface 154 of rear wall portion 150. Stud 152 provides an attachment for fuse element 16 to trunnion 24.

Trunnion 24 also includes a link ejector 156 pinned thereto having a spring portion 158 and tab portion 160 to ensure proper toggle action of trunnion 24. In particular, spring portion 158 acts to bias fuse element 16 out of fuseholder 26 protecting fuse cutout 10 from burning up. Also an interlocking feature between link ejector 156 and fuseholder 26 prevents excess tension on fuse link 16 during closure (not shown).

Fuseholder 26 comprises an elongated fuse tube 162 having opposing upper and lower ends 164 and 166. Fuse tube 162 is preferably made of fiberglass and can be coated with an ultra-violet inhibitor. Upper end 164 includes a cap 168 screwed onto fuse tube 162 is preferably formed of a highly conductive material, such as copper, and can be silver plated to provide efficient current transfer. Cap 168 includes a top portion 170 for engaging cavity 48 of upper contact 42 an upper support member 32 when fuseholder 26 is the closed position. Upper end 164 further includes a top tube casting 172 having a pull ring 174 extending therefrom in a frontward direction for opening and closing fuseholder 26 with conventional disconnect tools.

Lower end 166 includes a bottom tube casting 176 having a base 178 and a pair of pivot extensions 180 extending therefrom in a rearward direction for engaging pivot portion 124 of trunnion 24. Each pivot extension 180 includes a pin hole 182 for receiving pin 140. Pivot extensions 180 are spaced to allow pivot portion 124 of trunnion 24 to be inserted between extensions 180 such that pin hole 142 of pivot portion 124 aligns with pin holes 182 of pivot extensions 180. Pin 140 can then be inserted through pin holes 182 and pin hole 142 pivotally connecting trunnion 24 and fuseholder 26. Biasing member 118 is inserted onto pin 140 between one pivot extension 180 and pivot portion 124 such that one end 184 engages bottom tube casting 176 biasing fuseholder 26 in a counter clockwise direction and an opposing end 186 of biasing member 118 engages second arm portion 128 biasing trunnion 24 in a clockwise direction, as view in FIG. 1. Lower end 166 also includes a toggle latch 187 extending downwardly therefrom, that keeps fuse element 26 from being over stressed when fuseholder 26 is slammed closed.

Assembly

Referring to FIGS. 1–10, to assemble fuse cutout 10, mounting assembly 12 is first mounted to the system pole by mounting member 30 in any conventional manner. A conductor that is connected to a power source or lines, can then be attached to upper terminal 108, in any known fashion. Lower terminal 110 can either be attached to another conductor or to a ground. Once mounting assembly 12 has been mounted, fuseholder assembly 14 can be assembled and engaged with mounting assembly 12.

Assembling fuseholder assembly 14 initially requires that trunnion 24 and fuseholder 26 be connected pivotally by pivot pin 140 and pivot holes 142 and 182, as described above. In addition, biasing member 118 must be placed between pivot portion 124 of trunnion 24 and one pivot extension 180 of fuseholder 26 with pivot pin 140 inserted through extension 180, biasing member 118, and pivot portion 124. Once trunnion 24 and fuseholder 26 have been coupled, fuse element 16 can then be inserted into fuse tube 162 of fuseholder 26 and connected to trunnion 24. Fuse element 16 is preferably any fuse element or link known in the art.

In particular, fuse element 16 is dropped into fuse tube 162 until the button head (not shown) on a first or upper portion 188 of fuse element 16 abuts upper end 164 of fuse tube 162. Cap 168 is then screwed onto upper end 164 until an inner surface of cap 168 abuts the button head, securing fuse element 16 in fuse tube 162. A second or lower portion 190 of fuse element 16, which extends through lower end 166 of fuse tube 162, can then be attached to trunnion 24.

To attach fuse element 16, spring portion 158 of link ejector 156 of trunnion 24 is first forced inward toward fuseholder 26 to allow fuse element 16 to be wrapped around spring portion 158 such that fuse element 16 extends along the bottom surface 159 of spring portion 158. Fuse element 16 can then be wound around stud 152, tightened, and secured by a nut such that fuseholder 26 and trunnion 24 form a rigid body. Spring portion 158 is released, applying pressure on fuse element 16 to ensure proper ejection of fuse element 16 upon melting. Fuseholder assembly 14 is now ready to be received in mounting assembly 12.

By inserting a hot stick through open inner area 146 of trunnion 24, fuseholder assembly can be placed in mounting assembly 12 by inserting trunnion 24 in hinge member 22 of mounting assembly 12. Specifically, extension pins 136 of trunnion 24 engage slots 88 of hinge member 22, allowing trunnion 24 to rotate freely with respect to hinge member 22. In addition, lower contacts 92 of hinge member 22 engaging cam portion 122 of trunnion 24 to create a current path.

The weight of fuseholder assembly 14 will drop fuseholder 26 to its full drop-out position. Fuseholder 26 can be closed by inserting the hot stick into pull ring 174 of fuseholder 26 and rotating fuseholder 26 to the closed position. Hooks 54 of mounting 20 act as guide when closing fuseholder 26 as well as guide portion 50 of upper contact 42. The cavity 48 in upper contact 42 catches top portion 170 of cap 168 of fuseholder 26 with biasing member 52 applying downward pressure on upper contact 42 holding fuseholder 26 in place.

Operation

Upon closing fuseholder 26, fuse cutout 10 is then operational as a protective device. As seen in FIGS. 1–3, top portion 170 of cap 168 of fuseholder 26 engages upper contact 42, as described above, when fuseholder 26 is in the closed position. Trunnion 24 is concurrently in a first position, preferably such that first pivot point 137 is substantially lower than and nearly vertically aligned with second pivot point 139. In addition, contact portion 102 of each lower contact 92 of hinge member 22 engages cam portion 122 of trunnion 24 with back-up springs 104 applying a first pressure to lower contacts 92 and cam portion 122, as best seen in FIGS. 2 and 7.

Under normal conditions, the current is allowed to travel through fuse cutout 10 when in its closed operative position. Specifically, the current will travel from a conductor to upper terminal 108 of mounting 20, through upper support member 32, through upper contact 42 to fuse element 16 via cap 168. The current would then travel through fuse element 16 to stud 152 of trunnion 24, through cam portion 122 of trunnion 24 to the parallel current paths created by lower contacts 92, through hinge member 122, and finally through lower terminal 110.

Figure 6:
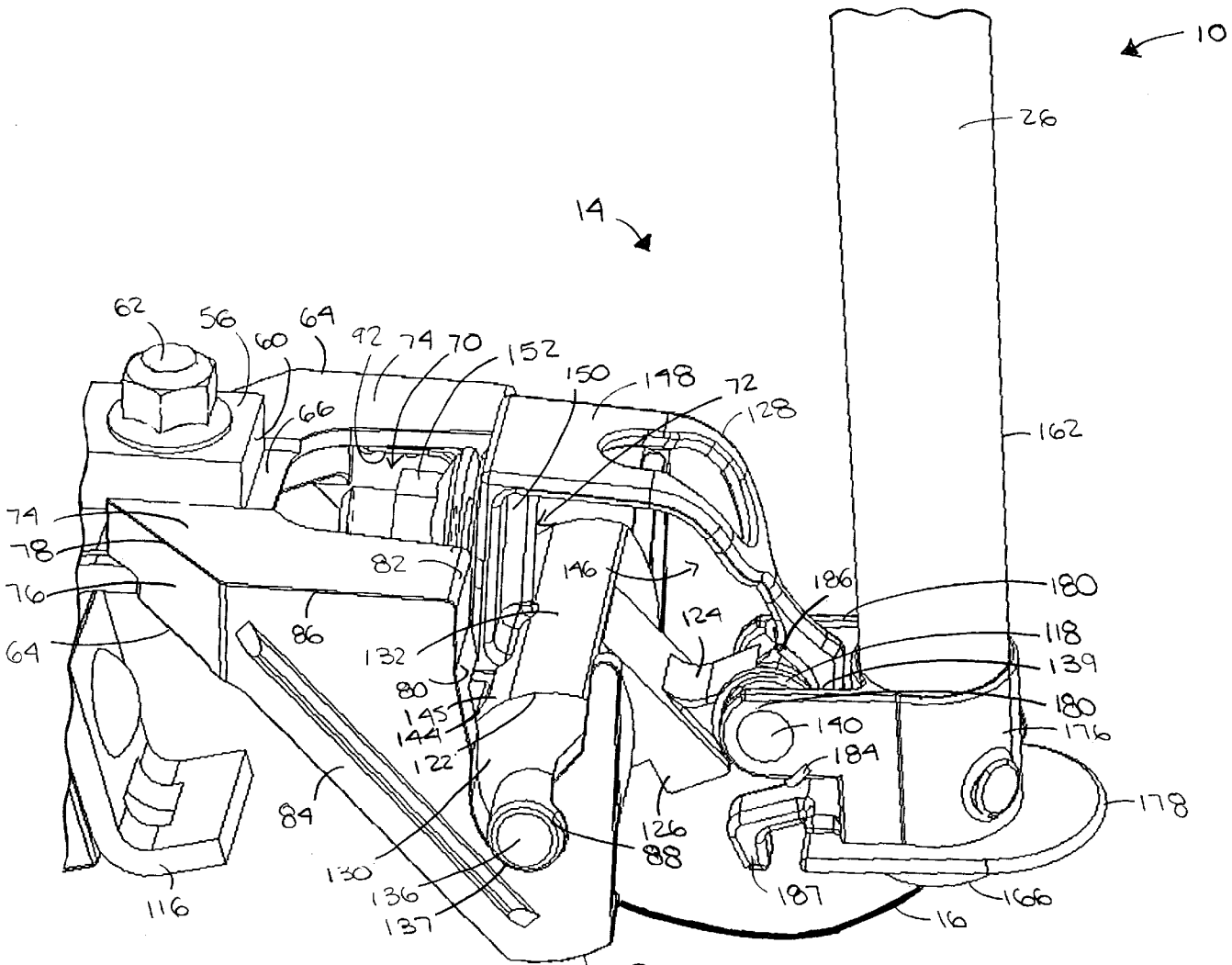
FIG. 6 is an enlarged, top, side, partial, perspective view of the fuse cutout illustrated in FIG. 5, showing the trunnion and the fuseholder in the open position.

Upon occurrence of an over current, fuse element 16 will melt separating first and second portions 188 and 190 such that trunnion 24 and fuseholder 26 are no longer a rigid body. In addition, upon separation of first and second portions 186 and 188, trunnion 24 is allowed to rotate with respect to hinge member 22, dropping fuseholder assembly 14 initially to an open position, as seen in FIGS. 5–6.

In particular, trunnion 24 drops to a second position corresponding to the open position of fuseholder 26, preferably wherein first pivot point 137 is only slightly lower and substantially horizontally aligned with second pivot point 139. Upon trunnion 24 rotating at first pivot point 137 to its second position, fuseholder 26 is simultaneously rotated downwardly at second pivot point 139 to its open position, such that cap 168 is spaced from upper contact 42, creating a fault interruption. The addition of biasing member 118 between trunnion 24 and fuseholder 26 provides a mechanical assist to fuseholder assembly 14 in rotating to the open position by providing a biasing force in the direction of the open position. Such a mechanical assist helps overcome any friction resulting from corrosion build up thus facilitating fuseholder assembly 14 in rotating to its open position and interrupting the over current. In addition, link ejector 156 acts to force fuse element 16 out of fuse tube 162 to prevent burn up of the cutout, as trunnion 24 rotates to its second position.

As seen in FIG. 8, when trunnion 24 is in its second position, planar cam surface 134 of trunnion 24 provides an immediate pressure relief between lower contacts 92 and cam portion 122. Specifically, upon rotation of trunnion 24 from its first position, when fuseholder 26 is closed as seen in FIG. 1, to its second position, when fuseholder 26 is open as seen in FIG. 5, contact portion 102 of lower contacts 92 moves from contacting curved top side 145 with a first pressure to contacting planar cam surface 134 with a second pressure. The second pressure is substantially less than the first pressure because surface 134 is flat and creates a slight separation between contact portion 102 and cam portion 122. This immediate reduction in pressure assists in overcoming any friction due to corrosion, thus facilitating the movement of fuseholder assembly 14 to its open position and the interruption of the over current.

Figure 10:
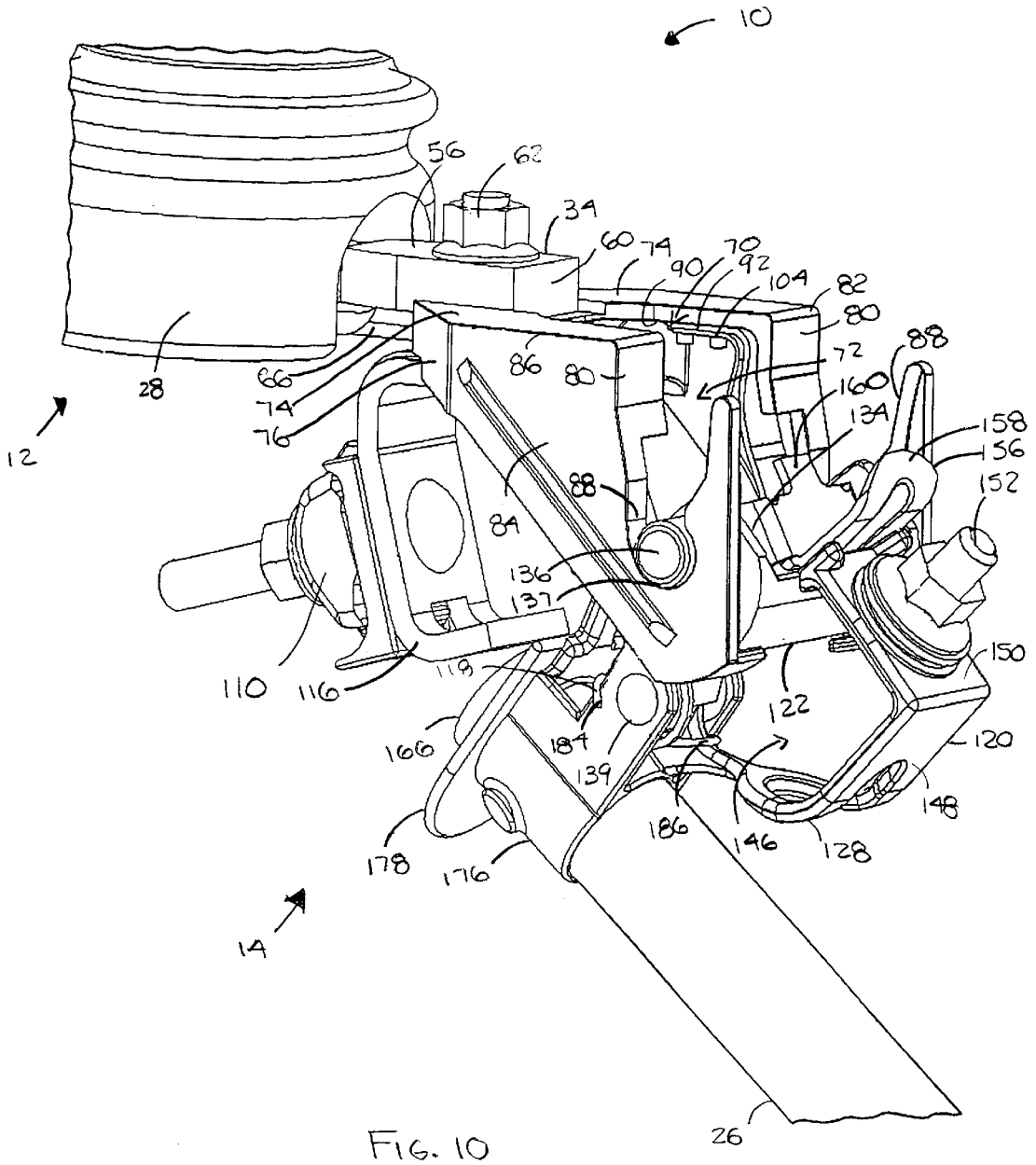
FIG. 10 is an enlarged front, side, partial, perspective view of the fuse cutout illustrated in FIG. 9, showing the trunnion and the fuseholder in the drop-out position.

Once fuseholder assembly 14 has initially dropped to an open position, gravity will allow fuseholder assembly 14 to drop to the full drop-out position, as seen in FIGS. 9 and 10. Trunnion 24 rotates to a third position wherein, second pivot point 139 is below first pivot point 137. Fuseholder 26 simultaneously rotates to the drop-out position such that upper end 164 and cap 168 are pointing downwardly. This allows fuse element 16 to be completely removed from fuseholder 26 by link ejector 156, preventing damage to the fuse cutout 10. Moreover, the fuseholder assembly 14 in the drop out position indicates that the over current has been interrupted and that it is safe to remove fuseholder assembly 14 from mounting assembly 12 and insert a new fuse element. Subsequently, fuseholder assembly 14 can be remounted to mounting assembly 12 and closed such that fuse cutout 10 is again operational.

Providing a biasing member or first biasing member 118 to fuseholder assembly 14, as described above, assures that fuse cutout 10 will consistently drop-out upon an occurrence of an over current, even in a corrosive environment, by overcoming the friction caused by corrosion on the moving parts of the cutout. Moreover, the planar cam surface 134 of cam portion 122 also assists in overcoming the friction, by providing a pressure relief. Alternatively, the force applied by biasing member or second biasing member 52 on upper contact 42 can be increased, further biasing fuseholder 26 to its open position, thus helping to overcome the friction. Furthermore, the friction can be reduced by adding corrosion inhibiting coatings to hinge member 22, trunnion 24, and upper and lower contacts 42 and 92. In addition, grease or paste containing corrosion inhibitors and solid lubricants can be added to the sliding or rotating surfaces.

While a particular embodiment has been chosen to illustrate the invention, it will be understood by those skilled in the art that various changes and modifications can be made therein without departing from the scope of the invention as defined in the appended claims.

What is claimed is:

1. A fuse cutout, comprising:

a mounting having upper and lower support members extending from opposing ends of said mounting, respectively;

a holder member fixedly attached to said lower support of said mounting, said holder member having a planar contact portion;

a pivot member received in said holder member at a first pivot point and being movable between first and second positions, said pivot member having a curved cam surface engaging said contact portion of said holder member with a first pressure when said pivot member is in said first position, and a planar cam surface engaging said contact portion with a second pressure when said pivot member is said second position, said second pressure being substantially less than said first pressure; and a fuseholder having upper and lower ends, said lower end being pivotally attached to said pivot member at a second pivot point.

2. A fuse cutout according to claim 1, wherein said contact portion is defined by a lower contact, said lower contact being attached to said holder member.

3. A fuse cutout according to claim 2, wherein said lower contact includes first and second sections with a middle section extending therebetween, said first section being substantially flush with said holder member, said middle section extending from said first section at an acute angle, and said second section extending from said middle section at an obtuse angle.

4. A fuse cutout according to claim 3, wherein said holder member includes a back-up spring disposed next to said lower contact biasing said lower contact toward said planar cam surface.

5. A fuse cutout according to claim 1, wherein said fuseholder is movable between closed and open positions at said second pivot point, said closed and open positions corresponding to said first and second positions of said pivot member, respectively.

6. A fuse cutout according to claim 5, wherein said pivot member has a camming portion, said camming portion includes said planar cam surface.

7. A fuse cutout according to claim 6, wherein said pivot member includes first and second arms extending between said camming portion and said second pivot point.

8. A fuse cutout according to claim 7, wherein said holder member includes a support surface and said pivot member includes an extension portion extending from said camming portion that rotates along said support surface at said first pivot point.

9. A fuse cutout according to claim 1, wherein a fuse element being disposed within said fuseholder having first and second portions, said first portion being connected to said fuseholder and said second portion being connected to said pivot member.

10. A fuse cutout according to claim 9, wherein when said first and second portions of said fuse element are connected, said fuse element supports said pivot member in said first position and said fuseholder in said closed position, and when said first and second portions of said fuse element are disconnected, said pivot member rotates to said second position and said fuseholder moves to said open position.

11. A fuse cutout according to claim 1, wherein said first pivot point is substantially lower than said second pivot point when said pivot member is in said first position, and said first pivot point is substantially horizontally aligned with said second pivot point when said pivot member is in said second position.

12. A fuse cutout, comprising:

a mounting having upper and lower support members extending from opposing ends of said mounting, respectively;

a holder member fixedly attached to said lower support of said mounting, said holder member having a planar contact portion;

a pivot member received in said holder member at a first pivot point and being movable between first and second positions, said pivot member having a curved cam surface engaging said contact portion of said holder member with a first pressure when said pivot member is in said first position, and a planar cam surface engaging said contact portion with a second pressure when said pivot member is said second position, said second pressure being substantially less than said first pressure;

a fuseholder having upper and lower ends, said lower end being pivotally attached to said pivot member at a second pivot point, said fuseholder being movable between closed and open positions corresponding to said first and second positions of said pivot member, respectively; and a first biasing member disposed between said pivot member and said lower end of said fuseholder at said second pivot point, biasing said pivot member toward said second position.

13. A fuseholder according to claim 12, wherein whereby said first pivot point is substantially lower than said second pivot point when said pivot member is in said first position, and said first pivot point is substantially horizontally aligned with said second pivot point when said pivot member is in said second position.

14. A fuseholder according to claim 12, wherein a fuse element is disposed within said fuseholder having first and second portions, said first portion being connected to said fuseholder and said second portion being connected to said pivot member; and when said first and second portions of said fuse element are connected, said fuse element supports said pivot member in said first position and said fuseholder in said closed position.

15. A fuse cutout according to claim 12, wherein a fuse element is disposed within said fuseholder having first and second portions, said first portion being connected to said fuseholder and said second portion being connected to said pivot member; and when said first and second portions of said fuse element are disconnected from one another, said pivot member is in said second position and said fuseholder is in said open position.

16. A fuse cutout according to claim 12, wherein said pivot member moves to a third position; and said fuseholder moves to a drop-out position, said drop-out position corresponds to said third position.

17. A fuse cutout according to claim 12, wherein said upper support member of said mounting includes an upper contact engaging said upper end of said fuseholder when said fuseholder is in said closed position; and said holder member includes a lower contact engaging said pivot member when said pivot member is in said first position.

18. A fuse cutout according to claim 17, wherein said upper support member of said mounting includes an upper terminal for connection to a power source; and said lower support member includes a lower terminal, said upper and lower terminals being electrically connected through said upper and lower contacts.

19. A fuse cutout according to claim 12, wherein said pivot member has a camming portion; and first and second arms extend between said camming portion and said second pivot point, said camming portion includes said planar cam surface.

20. A fuse cutout according to claim 12, wherein a second biasing member is disposed between said upper end of said fuseholder and said upper support member of said mounting assembly, said second biasing member biasing said fuseholder toward said open position.

21. A fuse cutout according to claim 20, wherein said first and second biasing members are springs.

22. A fuse cutout according to claim 12, wherein each of said holder member, said pivot member, and said contact portion include a corrosion inhibiting coating.

23. A fuse cutout, comprising:

a mounting having upper and lower support members extending from opposing ends of said mounting, respectively;

a holder member fixedly attached to said lower support of said mounting;

a pivot member received in said holder member at a first pivot point, said pivot member being movable between first and second positions;

an expulsion fuseholder having a fuse tube and a pivot extension, said pivot extension being pivotally attached to said pivot member at a second pivot point by a pin extending through each of said pivot extension and said pivot member, said fuseholder being movable between closed and open positions corresponding to said first and second positions of said pivot member, respectively;

a single fuse element being disposed within said fuse tube having unitary first and second positions, said first portion being connected to said fuse tube and said second portion being connected to said pivot member defining a current path therebetween; and a first spring disposed on said pivot pin and between said pivot member and said pivot extension of said fuseholder at said second pivot point, biasing said pivot member toward said second position without engaging said fuse tube of said fuse holder.

24. A fuse cutout according to claim 23, wherein said fuse element supports said pivot member in said first position and said fuseholder in said closed position with an upper end of said fuseholder contacting said upper support member of said mounting.

25. A fuse cutout according to claim 24, wherein said first pivot point is substantially lower than said second pivot point when said pivot member is in said first position, and said first pivot point is substantially horizontally aligned with said second pivot point when said pivot member is in said second position; and when said first and second portions of said fuse element are disconnected during a fault, said pivot member rotates to said second position and said fuseholder moves to said open position with said upper end of said fuseholder being spaced from said upper support member of said mounting.

26. A fuse cutout according to claim 23, wherein said pivot member includes a fastener attaching said fuse element to said pivot member.

27. A fuse cutout according to claim 23, wherein said upper support member of said mounting includes an upper contact extending therefrom and a second spring located between said upper support member and said upper contact, said upper contact engaging an upper end of said fuseholder when said fuseholder is in said closed position with said second biasing member biasing said fuseholder toward said open position.

28. A fuse cutout according to claim 23, wherein said upper support member of said mounting includes an upper contact, said upper contact engaging an upper end of said fuseholder when said fuseholder is in said closed position; and said holder member includes a lower contact engaging said pivot member when said pivot member is in said first position.

29. A fuse cutout according to claim 28, wherein said upper support member includes an upper terminal for connection to the power source; and said lower support member includes a lower terminal, said upper and lower terminals being electrically connected through said upper and lower contacts.

30. A fuse cutout according to claim 23, wherein said pivot member is movable to a third position, and said fuseholder is movable to a drop-out position, said drop-out position corresponding to said third position.

31. A fuse cutout according to claim 30, wherein said first pivot point is higher than said second pivot point when said pivot member is in said third position.

32. A fuse cutout according to claim 23, wherein said mounting includes a insulting member extending between said upper and lower support members, and mounting member extending from said insulating member.

33. A fuse cutout according to claim 23, wherein each of said holder member and said pivot member include a corrosion inhibiting coating, respectively.

* * * * *